United States Patent [19]

Navarro

[11] 4,062,615

[45] Dec. 13, 1977

[54] ELECTRICAL CONTACT

[75] Inventor: John N. Navarro, Pasadena, Calif.

[73] Assignee: Thomas & Betts Corporation, Elizabeth, N.J.

[21] Appl. No.: 748,231

[22] Filed: Dec. 6, 1976

[51] Int. Cl.[2] ..... H01R 9/08

[52] U.S. Cl. ..... 339/98

[58] Field of Search ..... 339/97–99

[56] References Cited

U.S. PATENT DOCUMENTS

| | | | |
|---|---|---|---|
| 3,805,214 | 4/1974 | Demler, Sr. et al. | 339/97 R |
| 3,824,527 | 7/1974 | Evans | 339/97 R |
| 3,892,460 | 7/1975 | Izraeli | 339/98 |

*Primary Examiner*—Joseph H. McGlynn

*Attorney, Agent, or Firm*—David Teschner; Jesse Woldman

[57] ABSTRACT

An electrical splice contact comprises a narrow central portion flanked by undulating slotted end portions having peaked segments providing piercing and cutting surfaces for engaging the ends of a pair of insulated conductors to provide an in-line electrical splice joint therebetween.

6 Claims, 10 Drawing Figures

ELECTRICAL CONTACT

BACKGROUND OF THE INVENTION

1. Field of the Invention

The invention is directed to the field of electrical devices for joining conductors.

2. Description of the Prior Art

Solderless devices for joining electrical conductors are well known in the prior art. Earlier devices adapted to provide a splice connection between two bared conductors generally comprised a tapered ferrule seated within an insulated housing and adapted to be inserted over the conductors and twisted to provide mechanical engagement therebetween. Subsequent devices designed to eliminate the stripping operation generally involved slotted metallic plates having upstanding leg portions, each of the slots being arranged to receive a conductor placed therein crosswise of the plane of the plate. Such devices, however, require considerable care in use since the use of differently sized conductors in adjacent positions would cause undue deflection of the leg portions and a corresponding loss of electrical integrity between the plate and the conductor. A more recent device designed to at least partially alleviate this problem is disclosed in U.S. Pat. No. 3,892,460, issued to H. Izraeli on July 1, 1975 and assigned to the assignee of the instant invention. This device, although representing a material improvement over such other devices, is designed primarily for parallel rather than in-line splicing, and is further subject to some degree of distortion when employed in conjunction with conductors of widely varying sizes because of the common feature found in most prior art slotted plate contacts whereby an intermediate segment of the contact is acted on simultaneously by counteracting forces generated by the contained conductors. There is also a need for an in-line splice contact which may be advantageously employed to simultaneously interconnect a plurality of parallel conductors such as may be found in flat ribbon cable or the like.

SUMMARY OF THE INVENTION

The invention overcomes the problems and limitations noted above with respect to prior art devices by providing an elongate electrical contact having colinear conductor receiving slotted end portions each arranged to independently accept a respective conductor end. Each end portion is arranged in an undulating or wavy pattern and comprises in one embodiment, a series of three peaked segments interrupted by insulation piercing and conductor engaging slots aligned along a common central axis. The side edges defining the slots and the upper edges of each peaked segment cooperatively define contiguous cutting surfaces to provide, in such embodiment, six discrete lines of contact with an engaged conductor. One of such devices may be individually supported in a suitable enclosure to provide a splice connection for two insulated conductors, or a series thereof may be arranged in juxtaposed parallel relationship in a suitable holder to provide an end-to-end multiple splice connection for the opposing ends of two insulated ribbon type multiconductor cables. It is therefore an object of this invention to provide an improved electrical contact.

It is another object of this invention to provide a rapid, inexpensive, and reliable in-line splice connection between two conductors.

It is a further object of this invention to provide a rapid, inexpensive, and reliable in-line splice connection between two insulated conductors while avoiding the necessity for stripping the insulation therefrom prior to assembly.

It is yet another object of this invention to provide a device which will electrically join two insulated conductors while providing independent support for each of the conductors.

It is yet a further object of this invention to provide mechanical isolation and electrical continuity between two conductors in a unitary in-line splice connection.

It is still another object of this invention to provide a electrical contact arranged to provide a reliable solderless splice connection between conductors of widely varying sizes.

It is still a further object of this invention to provide a rapid, efficient, inexpensive, and reliable means for establishing a splice connection between the conductors of two multiconductor ribbon cables.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
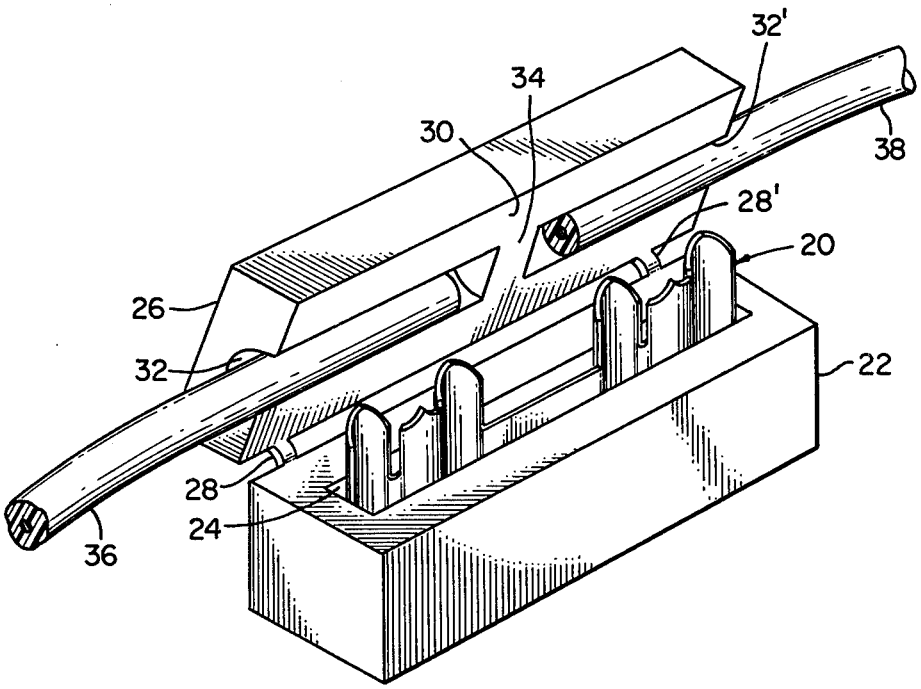
FIG. 1 is a perspective view showing an assembly including an electrical contact constructed in accordance with the concepts of the invention.
Figure 2:
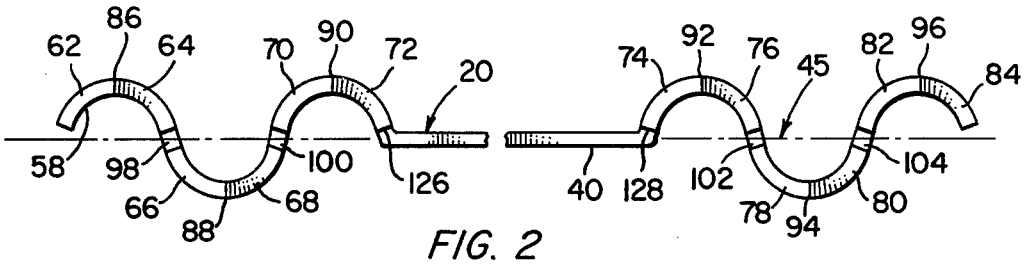
FIG. 2 is a fragmentary top plan view of the contact of FIG. 1.
Figure 3:
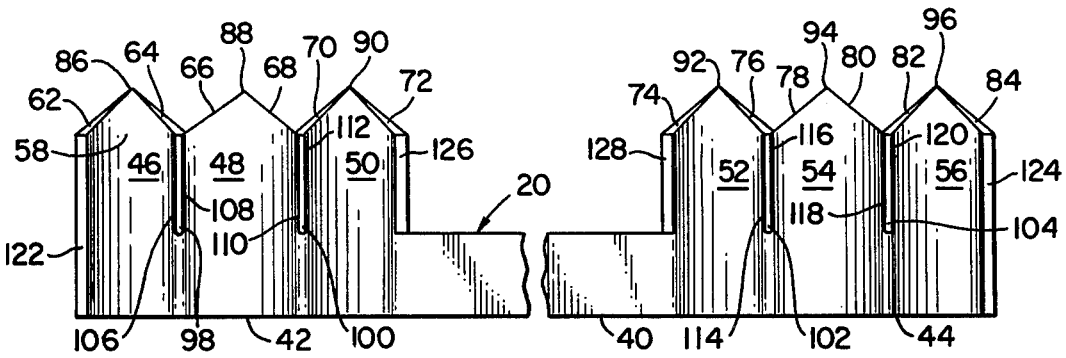
FIG. 3 is a fragmentary side elevational view of the contact of FIG. 1.
Figure 4:
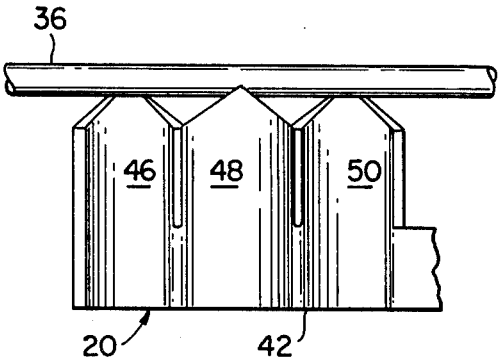
FIG. 4 is a fragmentary side elevational view showing the initial engagement between an insulated conductor and the contact of FIG. 1.
Figure 5:
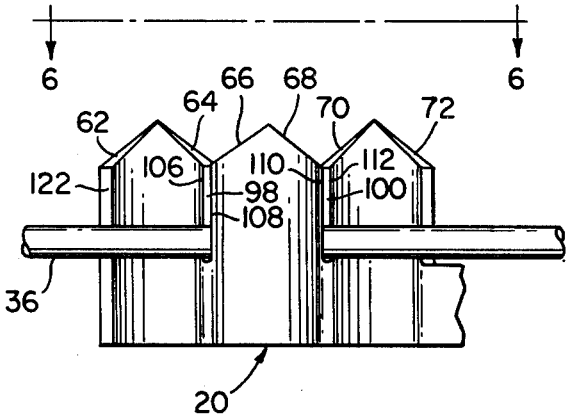
FIG. 5 is a fragmentary side elevational view similar to FIG. 4 showing the elements of FIG. 4 in a further state of engagement.
Figure 6:
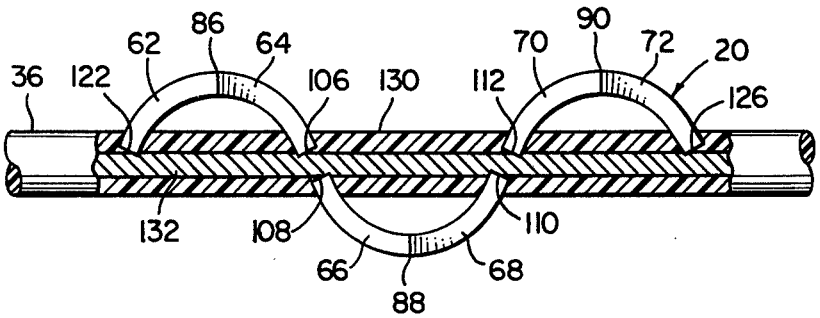
FIG. 6 is a fragmentary top plan view, partly cut away and partly in section, taken along the line 6—6 of FIG. 5.
Figure 10:
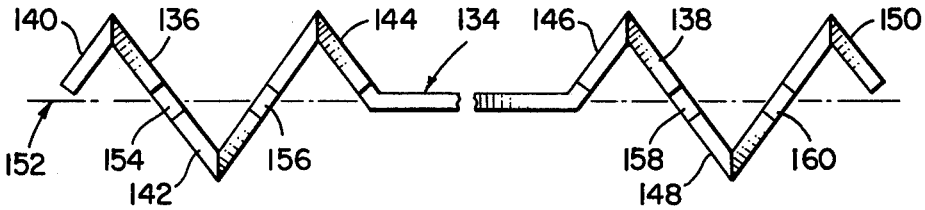
FIG. 10 is a fragmentary top plan view of a further embodiment of an electrical contact constructed in accordance with the concepts of the invention.

Turning now to FIGS. 1 through 6 there is shown an electrical contact 20 constructed in accordance with the concepts of the invention. For the sake of convenience, the contact 20 is shown in FIG. 1 as being supported in a base member 22 constructed preferably of rigid dielectric material and having an elongate recess 24 in which the contact 20 is located. A cover portion 26 is shown attached to the base portion 22 by the hinges 28, 28', and includes an interior surface 30 having longitudinally extending colinear grooves 32, 32' separated by a centrally located web portion 34 which acts as a stop for the opposing ends of a pair of insulated conductors 36, 38 located in respective grooves 32, 32'. As shown in the enlarged views in FIGS. 2 and 3, the contact 20, which is fabricated preferably from a contiguous strip of electrically conductive metallic material, includes a flat central portion 40 interconnecting opposing end portions 42 and 44 which are shown as formed in a wavy or undulating pattern bisected by a common central axis 45 and defining a series of serially arranged segments 46, 48, and 50 on the left side of the contact 20, as viewed in FIG. 3, and a series of serially arranged segments 52, 54, and 56 on the right side of the contact 20, as viewed in FIG. 3. Each of the segments 46, 48, 50, 52, 54, and 56 is selectively contoured to define an arcuate shape having a concave interior surface which is indicated by the numeral 58 with respect to segment 46 and which surface 58 is exemplary of the interior surfaces of the remaining segments. Each of the segments 46, 48, 50, 52, 54, and 56 is further defined by a pair of upper edges 62 and 64, 66 and 68, 70 and 72, 74 and 76, 78 and 80, and 82 and 84, respectively, each pair of which converges to a respective peak 86, 88, 90, 92, 94, 96. Intermediate each adjacent pair of segments is a selectively dimensioned slot oriented generally perpendicular to the axis 45 and shown as slot 98 intermediate segments 46 and 48, slot 100 intermediate segments 48 and 50, slot 102 intermediate segments 52 and 54, and slot 104 intermediate segments 54 and 56, each of the slots 98, 100, 102 and 104, being defined by side edges such as 106 and 108 bordering slot 98, edges 110 and 112 bordering slot 100, edges 114 and 116 bordering slot 102 and edges 118 and 120 bordering slot 104. The segments 46 and 56 at the extreme ends of contact 20 each terminate in an additional respective side edge 122, 124, and the inner segments 50 and 52 each include an interior side edge 126, 128, respectively. Each of the upper edges and side edges provide cutting surfaces for piercing through the insulation and engaging the conductive portion of an insulated conductor such as 36, 38, as the conductor is placed along the contact 20 parallel to the central axis 45 in the manner shown in FIG. 4 and driven downwardly, as viewed in FIG. 4, to a position such as shown in FIG. 5. In the case of a single discrete insulated conductor such as 36 or 38, which, as shown in FIG. 6 with respect to conductor 36, comprises an outer insulating jacket 130 and an inner conductive portion 132, and has a diameter slightly greater than the width of the slots 98, 100, 102, and 104, the predominant insulation piercing action is performed by the side edges 106, 108, 110, 112, 114, 116, 118, 120, 122, and 124. To effect an electrical connection between two conductors such as 36 and 38, one end of each is placed over a respective end portion 42 and 44 of the contact 20 in a manner similar to that shown in FIG. 1 and forced against the respective end portions 42 and 44 to a position such as that shown in FIG. 5 with respect to the conductor 36. Consequently, the side edges 106, 108, 110, 112, 122, and 126 of end portions 42 are caused to sever the insulation 130 and engage the conductive portion 132 of the conductor 36, while the side edges 114, 116, 118, 120, 128, and 124 perform a similar function with respect to the conductor 38. The two conductors 36 and 38 are thus electrically joined to one another while each is independently mechanically supported by a respective end portion 42 and 44 of the contact 20. An in-line splice connection between the conductors 36 and 38 is thus achieved in a rapid, simple, and reliable manner with a minimum of preparation since the insulation piercing feature of the contact 20 avoids the need for stripping or otherwise preparing the conductor ends prior to assembly. It should also be appreciated that, since each end portion 42, 44 functions as an independent support for its respective conductor, conductors of widely varying sizes may thus be safely and reliably joined together since the degree of deflection, if any, experienced by one end portion upon receipt of a particular conductor is not transmitted to the other end portion. In the particular embodiment shown in FIG. 2, each of the segments, of which segment 46 is exemplary, is arcuately formed in a substantially semicylindrical shape although other undulating patterns may be employed without departing from the spirit of the invention and within the concepts herein disclosed. For example, in FIG. 10 there is shown a contact 134 having end portions 136 and 138 which are arranged in a series of V-shaped segments 140, 142, 144, 146, 148, and 150, which segments otherwise include all of the remaning features of the contact 20. As with the end portions 42 and 44 of the contact 20, the undulating end portions 136 and 138 of contact 134 are bisected by a common central axis 152 corresponding to axis 45 shown in FIG. 2, and which further bisects conductor receiving slots 154, 156, 158, and 160 in end portions 136 and 138, which slots correspond, respectively, to slots 98, 100, 102, and 104 of contact 20. Returning now to FIGS. 1 through 6, each of the upper edges 62, 64, 66, 68, 70, 72, 74, 76, 78, 80, 82, and 84 may be inclined at an included angle of between five degrees and forty-five degrees to an axis parallel to the central axis 45 to enhance the progressive piercing and cutting action thereof.

Figure 7:
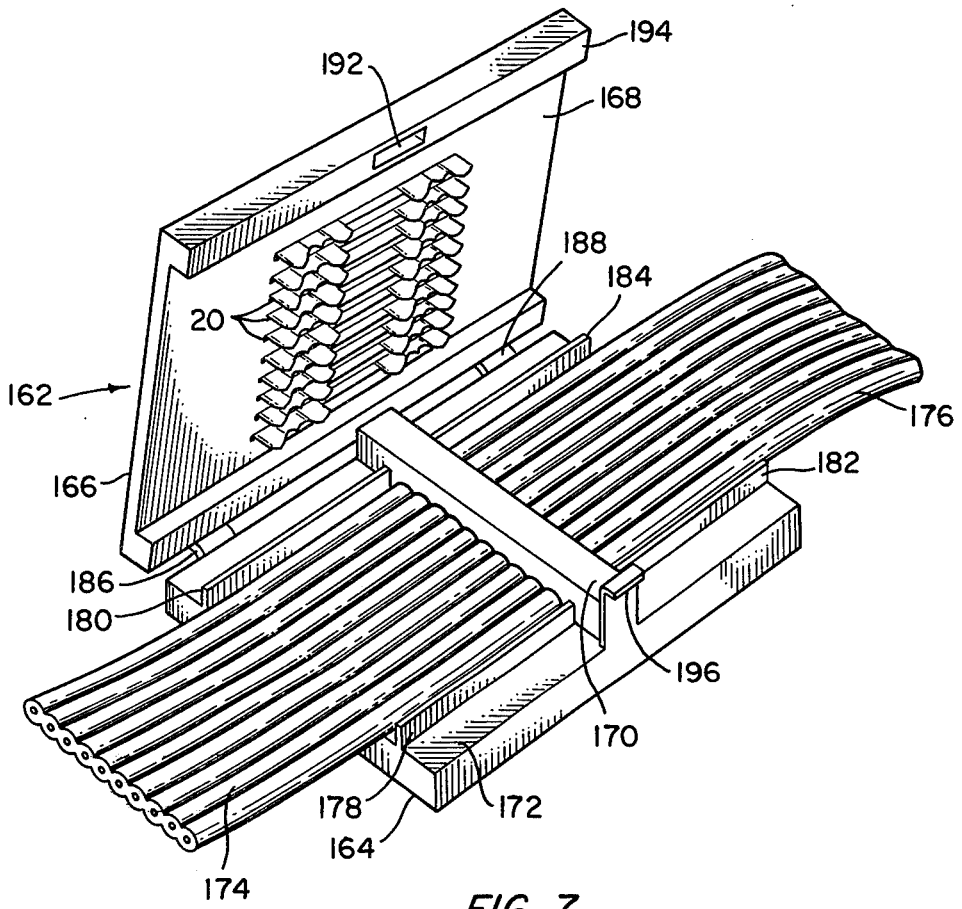
FIG. 7 is a perspective view of a further embodiment of an electrical connector employing an electrical contact constructed in accordance with the concepts of the invention.
Figure 8:
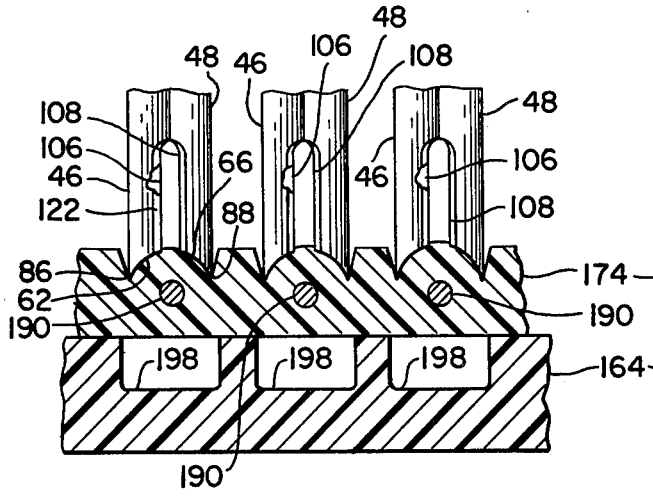
FIG. 8 is a fragmentary side elevational view, partly in section, of a portion of the device of FIG. 7 in an initial state of closure.
Figure 9:
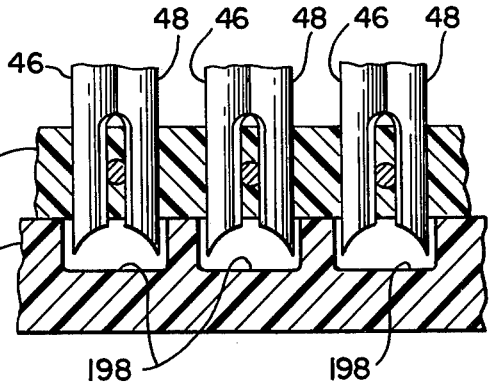
FIG. 9 is a fragmentary side elevational view, partly in section, of a portion of the device of FIG. 7 in a further state of closure.

Turning now to FIGS. 7, 8, and 9, there is shown a connector assembly 162 having a base portion 164, a cover portion 166, and a series of contacts 20 seated in the undersurface 168 of the cover portion 166 and arranged in selectively spaced, juxtaposed, parallel alignment. A transvesely extending central bridge portion 170 is located on the interior surface 172 of the base portion 164 and provides an abutment or stop for the opposing end portions of two multiconductor flat ribbon cables 174 and 176 which are seated on the interior surface 172 of the base portion 164. Shoulders 178 and 180 located on the left side of the interior surface 172, as viewed in FIG. 7, provide guide and locating means for the cable 174, while similar shoulders 182 and 184 located on the right side of the interior surface 172, as viewed in FIG. 7, provide guide and locating means for the cable 176. Hinge means 186 and 188 serve to conveniently couple the base portion 164 to the cover portion 166. The base and cover portions 164 and 166, respectively, may be constructed from any suitable conventional dielectric material well known in the art, to provide an electrically insulating enclosure for the contacts 20. The connector assembly 162 is especially suited to provide a multiple electrical splice connection between corresponding conductors of the cables 174 and 176 in much the same manner as that provided by the single contact 20 in accordance with the device of FIG. 1. In this case, however, any number of spaced, parallel, insulated conductors of one cable may be simultaneously electrically spliced to corresponding conductors of another cable while being afforded the same highly desirable mechanical isolation described heretofore. The manner in which the upper edges of the individual segments of the contact 20, as exemplified by the edges 62 and 66 shown in FIG. 8, serve to pierce and cut through the insulation surrounding each of the conductors of the cable 174 is shown in detail in FIGS. 8 and 9. For the sake of clarity only the segments 46 and 48 and their associated cutting edges 62 and 66 are shown, although it should be understood that the remaining cutting edges operate in a similar fashion to achieve the desired insulation cutting and piercing function. To initiate the splice connection, the cover 166 of the connector assembly 162 is folded downwardly, as viewed in FIG. 7, towards the base member 164. It should, of course, be appreciated that the cover portion 166 may be arranged for cooperative engagement with the base portion 164 in other than hinged relationship whereby the cover portion 166 may comprise, for example, a separate element adapted to be placed over the base portion and fastened thereto after closure. In any event, with respect to the embodiment shown in FIG. 7, as the cover portion 166 is folded downwardly, the peaks 86 and 88, for example, of the respective segments 46 and 48 initially engage the adjacent insulating layer of cable 174 and begin the piercing and cutting action which is further accomplished by the tapered upper edges 62 and 64 as the cover portion 166 is advanced towards the base portion 164. Each conductor of the cable 174 and 176 is thus flanked by the respective upper edges of the respective contact segments and the insulation thereabout pierced and severed as the cover portion 166 is brought progressively closer to the base portion 164. Continued closure of the cover portion 166 causes the side edges such as 106 and 108, for example, of the slot 98 to engage a corresponding conductor shown in FIG. 8 as 190 of the cable 174 in such manner as to provide electrical engagement therebetween. A similar action will, of course, take place at the other end portions 44 of the contacts 20 so that a conductor of cable 174 is electrically joined to an opposing conductor of cable 176. This sequence is repeated with respect to each of the contacts 20 located in the cover portion 166 whereby, according to the number of contacts 20 employed in the assembly 162, a given number or all of the conductors of cable 174 are electrically connected to a corresponding number of conductors of cable 176. For the sake of convenience, the cover portion 166 is shown provided with an opening 192 within the free edge 194 thereof which is adapted to lockingly receive a latch finger 196 extending outwardly from the interior surface 172 of the base portion 164 of the connector assembly 162 as the cover portion 166 is folded down to a fully closed position. A series of recesses 198 (FIG. 8) are provided in the interior surface of the base portion 164 to provide clearance for the portions of the segments 46, 48, 50, 52, 54, and 56, as shown in FIG. 9 with respect to the segments 46 and 48, which extend beyond the distal surface of the cables 174 and 176 upon complete closure of the cover portion 166 to the base portion 164. Since the central portion 40 of the contact 20 is relatively flexible, it will be appreciated that the end portions 42 and 44 may be selectively offset from one another so that, in the embodiment illustrated in FIG. 7, the contacts 20 may be conveniently employed to provide a splice connection between cables such as 174 and 176 which may have differently pitched conductor spacings. In such case, the recesses in which the contacts 20 are held in the cover portion 166 may be appropriately obliquely oriented with respect to a central axis parallel to the longitudinal axis of the cables 174 and 176 so that the spacing between adjacent end portions 42 corresponds to the spacing between the conductors of the cable 174 while the spacing between adjacent end portions 44 corresponds to the spacing between the conductors of the cable 176.

The embodiments of the invention in which an exclusive property or privilege is claimed are defined as follows:

1. An electrical contact for joining two insulated conductors comprising: a continuous linear strip of electrically conductive metallic material having a flat central portion and undulating end portions, each of said end portions comprising a series of at least three serially connected segments each having upper edges converging to a peak at the longitudinal center of each said segment, and communicating with a side edge to provide a cutting surface extending from said peak along each of said upper edges and continuing along each of said side edges, said side edges between adjacent segments defining the sides of a slot for receiving the conductive portion of an insulated conductor therein, each of said slots lying along and bisected by a common central axis to provide an in-line wire receiving path, said side edges providing cutting surfaces for piercing the insulation about such insulated conductor, said end portions each being adapted to engage a severed end of a given insulated conductor to provide electrical continuity between such conductors, said segments undulating symmetrically about said common central axis.

2. An electrical contact as defined in claim 1 wherein each of said segments is substantially arcuately formed about its longitudinal axis.

3. An electrical contact as defined in claim 1 wherein each of said segments is substantially semicircular in cross section.

4. An electrical contact as defined in claim 1 wherein said upper edges of said segment slope from said peak towards said side edges of said segment at an included angle of between 45° and 85° with an axis extending from said peak to the distal end of said segment.

5. An electrical contact as defined in claim 1 wherein said central portion is colinear with said end portions.

6. An electrical contact as defined in claim 5, the width of said central portion being defined by spaced, parallel, first and second edges, said first edge being substantially coextensive with one edge of said strip, said second edge having a shorter length than said first edge and extending to an adjacent end portion and communicating with one of said side edges of a respective one of said segments.

* * * * *